US010422334B2

(12) United States Patent
Turczak

(10) Patent No.: US 10,422,334 B2
(45) Date of Patent: Sep. 24, 2019

(54) METHOD FOR CONTROLLING A PUMP SYSTEM AND PUMP SYSTEM

(71) Applicant: WIWA WILHELM WAGNER GMBH & CO. KG, Lahnau (DE)

(72) Inventor: Peter Turczak, Wetzlar (DE)

(73) Assignee: WIWA WILHELM WAGNER GMBH & CO. KG, Lahnau (DE)

( * ) Notice: Subject to any disclaimer, the term of this patent is extended or adjusted under 35 U.S.C. 154(b) by 168 days.

(21) Appl. No.: 15/310,382

(22) PCT Filed: Mar. 25, 2015

(86) PCT No.: PCT/EP2015/056456
§ 371 (c)(1),
(2) Date: Nov. 10, 2016

(87) PCT Pub. No.: WO2015/172930
PCT Pub. Date: Nov. 19, 2015

(65) Prior Publication Data

US 2017/0152848 A1 Jun. 1, 2017

(30) Foreign Application Priority Data

May 14, 2014 (DE) ..... 10 2014 209 157

(51) Int. Cl.
*F04B 49/06* (2006.01)
*F04B 13/02* (2006.01)
(Continued)

(52) U.S. Cl.
CPC ..... *F04B 49/065* (2013.01); *B05B 7/26* (2013.01); *B05B 11/3001* (2013.01);
(Continued)

(58) Field of Classification Search
CPC ..... B05B 7/26; B05B 11/30; B05B 11/3001; B05B 12/08; B05B 12/00; B05B 1/00; B05B 7/2472; B05B 7/04
(Continued)

(56) References Cited

U.S. PATENT DOCUMENTS 4,529,127 A 7/1985 Huszagh
4,580,721 A * 4/1986 Coffee ..... B05B 5/16 239/303
(Continued)

FOREIGN PATENT DOCUMENTS

CN 102454585 5/2012
DE 1012195 B 7/1957
(Continued)

OTHER PUBLICATIONS

The Patent Office of the People's Republic of China, Office Action, Application No. of Patent Application 201580035240.8, dated Jan. 23, 2018, China.

*Primary Examiner* — Steven J Ganey
(74) *Attorney, Agent, or Firm* — King & Schickli, PLLC

(57) ABSTRACT

The invention relates to a method for controlling a pump system and to a pump system (34) having a pump unit (44) for dispensing multi-component material under pressure by means of a spray gun, the pump unit comprising a pump device (12), a mixer (13) and a spray gun (14), the pump device having at least two pumps (16, 17) for pumping component material and associated liquid tanks (18, 19) for storing component material, the pump device having an operating means (23) by means of which the pump device is controlled, wherein the pump unit comprises at least one other pump device (35), the pump system having a control device (24), the control device and the operating means (23,
(Continued)

40) together forming a control unit (41), the pump unit being controlled by means of the control unit.

17 Claims, 4 Drawing Sheets

(51) Int. Cl.

| | |
|---|---|
| ***F04B 17/03*** | (2006.01) |
| ***F04B 17/06*** | (2006.01) |
| ***B05B 7/26*** | (2006.01) |
| ***B05B 11/00*** | (2006.01) |
| ***B05B 12/08*** | (2006.01) |
| ***F04B 19/22*** | (2006.01) |
| ***F04B 23/02*** | (2006.01) |
| ***F04B 49/02*** | (2006.01) |
| ***F04B 49/10*** | (2006.01) |

(52) U.S. Cl.
CPC ..... *B05B 12/08* (2013.01); *F04B 13/02* (2013.01); *F04B 17/03* (2013.01); *F04B 17/06* (2013.01); *F04B 19/22* (2013.01); *F04B 23/02* (2013.01); *F04B 49/02* (2013.01); *F04B 49/06* (2013.01); *F04B 49/10* (2013.01)

(58) Field of Classification Search
USPC ..... 239/104, 106, 112, 1, 69, 303–305, 525, 239/398
See application file for complete search history.

(56) References Cited

U.S. PATENT DOCUMENTS

| | | | | |
|---|---|---|---|---|
| 4,928,880 | A * | 5/1990 | Prus | B05B 12/085 239/112 |
| 5,403,089 | A | 4/1995 | Kuo et al. | |
| 6,047,902 | A | 4/2000 | Hofmann | |
| 6,105,880 | A * | 8/2000 | Bazil | B01F 3/024 239/303 |
| 2002/0069822 | A1 | 6/2002 | Dattilo | |
| 2002/0100815 | A1 | 8/2002 | Doebler et al. | |
| 2011/0257788 | A1 | 10/2011 | Wiemers et al. | |

FOREIGN PATENT DOCUMENTS

| | | | |
|---|---|---|---|
| DE | 10121950 | A1 | 11/2002 |
| DE | 20206267 | U1 | 8/2003 |
| DE | 102007017445 | | 2/2007 |
| DE | 602004005154 | T2 | 11/2007 |
| DE | 102007017445 | B3 | 9/2008 |
| DE | 102007016385 | A1 | 10/2008 |
| DE | 112011103835 | T5 | 8/2013 |
| DE | 102012103252 | A1 | 10/2013 |
| DE | 102012104214 | A1 | 11/2013 |
| EP | 0478944 | A1 | 4/1992 |
| EP | 1084756 | A2 | 3/2001 |
| EP | 2181774 | A1 | 5/2010 |
| WO | 2013178306 | A1 | 12/2013 |
| WO | 2015172929 | A1 | 3/2015 |
| WO | 2015172931 | A1 | 3/2015 |

* cited by examiner

METHOD FOR CONTROLLING A PUMP SYSTEM AND PUMP SYSTEM

FIELD OF THE INVENTION

The invention relates to a method for controlling a pump system and to a pump system having a pump unit for dispensing multi-component material under pressure by means of a spray gun, the pump unit comprising a pump device, a mixer and a spray gun, the pump device having at least two pumps for pumping component material and associated liquid tanks for storing component material, the pump device having an operating means by means of which the pump device is controlled.

BACKGROUND OF THE INVENTION

Pump systems and methods of this kind for controlling and operating pump systems are well known from the state of the art and are regularly used for surface coating, i.e. to apply or spray multi-component material onto a surface. The multi-component material consists of one or more basic component materials and a hardener component material, each of these component materials being stored separately in liquid tanks. Each liquid tank is associated with a pump for pumping the respective component material. Preferably, pneumatically driven piston pumps are used in this context; however, other types of pumps may be used as well. By means of the respective pumps, the component materials are pumped to a so-called mixer and are mixed within the mixer in such a manner that the thus formed multi-component material can harden. From the mixer, the multi-component material is pumped under pressure to a so-called spray gun by means of the pump. The spray gun does not necessarily have to be in the shape of a gun, but can be any type of nozzle by means of which the multi-component material can be sprayed onto a surface by atomization. Optionally, one or more heaters can be provided for adjusting the temperature of the component material. Together, the pumps and the liquid tanks form a pump device, which can be operated and controlled by an operator via an operating means.

In many cases, a pump device of this kind is designed portable, allowing it to be easily placed in the proximity of the items to be coated. Via the operating means, the pump device can be switched on and off, and it is also possible for a mixing ratio of the component materials to be adjusted at the operating means. An adjustment of this kind usually takes place by varying the respective delivery rate of the pumps. Hence, the operating means can also have various sensors, flow-rate measuring devices, stroke-length measuring devices or similar means for determining and influencing a delivery rate of the pumps. Moreover, a delivery line of the pumps as well as of the mixer and of the spray gun must always be purged after use or when changing colors, for example. Hence, the operating means often has a so-called purging function.

A pump unit formed by a pump device, a mixer and a spray gun is used in situ for coating surfaces with an anticorrosive coating or paints on or in ships, metal buildings or industrial installations, for example. The substantial aspect is that the pump unit can be easily transported by an operator and be put into operation at the respective work site. A delivery line from the pump device to the spray gun can have a length of a few meters to several hundred meters. This is especially the case when surface coating takes place in difficult-to-access places, such as within a ship's hull.

It is further known for stationarily installed pump units to be used instead of transportable pump units. Pump units of this kind are provided with a pump device having more than two pumps and liquid tanks. Said pump units can be used in a paint booth, for example, where it will thus be possible to have a plurality of component materials, such as different colors, in simultaneous use. For instance, multiple component materials or colors can thus be simultaneously mixed with a hardener component material and be sprayed with the spray gun. The spray gun does not necessarily have to be handled by an operator; it can also be mounted on a robot arm. In this case, it is also possible to continuously change a color, for example, by allowing for automatic intermediate purging of the relevant delivery lines as well as of the mixer and the spray gun. The substantial aspect is that the pump device is configured according to individual requirements to have a number of up to 30 pumps and liquid tanks, for example, a shared operating means for controlling and operating all pumps being provided. In case of this configuration of a pump unit, however, it is disadvantageous if a function of the operating means or even just one pump fails, for example. This will lead to a standstill of the entire pump unit for a longer period of time because in addition to an error search, the pump unit will have to shut down in order to replace a pump or components of the pump device. The pump units are also designed for an individual application in each case, such as for a specific paint booth. In case of potential changes to the paint booth or in case of subsequent use of the pump unit for a different purpose, extensive restructuring of the pump unit is required.

SUMMARY OF THE INVENTION

Hence, the object of the present invention is to provide a method for controlling a pump system and a pump system by means of which longer downtimes can be avoided and which allows flexible use at the same time.

This object is attained by a method having the features of claim 1 and by a pump system having the features of claim 9.

In the method according to the invention for controlling a pump system having a pump unit for dispensing multi-component material under pressure by means of a spray gun, the pump unit comprises a pump device, a mixer and a spray gun, the pump device having at least two pumps for pumping component material and associated liquid tanks for storing component material, the pump device having an operating means by means of which the pump device is controlled, wherein the pump unit comprises at least one other pump device, the pump system having a control device, the control device and the operating means together forming a control unit, the pump unit with the pump devices being controlled by means of the control unit.

Consequently, the pump unit comprises at least four pumps and two operating means, each of which is associated with one pump pair. The two operating means and the control device together form a control unit. By means of the control device, the operating means can each be separately controlled and data can be exchanged between the operating means and the control device. The control unit thus serves to influence the operation of the pump unit. Overall, a modular structure of a pump unit is thus made possible by the control device allowing control of all pump devices. In contrast to the known state of the art, it is thus no longer necessary to build pump units that are supposed to have a plurality of pumps from individual pumps. Instead, the pump unit according to the invention is built from a plurality of standardized pump devices each having an operating means. The pump devices can thus also be operated autonomously. Only the control device is connected to all operating means of the pump devices and controls them as needed in the manner of a superimposed control. If now a failure of a pump occurs, this means that the pump unit can continue to operate because the affected pump device can simply be replaced without having to shut down the remaining pump devices and the control device. The defective pump device can thus be repaired at a location independent from the pump unit and can be kept ready for replacement.

It is furthermore conceivable that the control device automatically shuts down a pump device when needed and activates a pump device kept in reserve. Also, a construction effort for building a pump system of this kind or a pump unit of this kind is substantially reduced because standardized pump devices that are already equipped with an autonomous control in the form of the operating means can be employed. Flexible restructuring of the pump system is made possible, too, owing to the fact that the control device will only need to be adjusted to a changed number of pump devices. In this case, the control device is configured in such a manner that any number of pump devices can be controlled by means of the control device. The control unit can thus also control individual pumps via the respective operating means, in principle making it immaterial for a function of the pump system whether a specific pump is associated with a specific pump device.

The control device can be arranged at a distance from the pump unit, data being exchangeable between the control device and the operating means. In particular owing to the fact that a control unit having a control device can be provided in addition to the pump unit, the operating means can communicate with the control device by exchanging data. However, in this case, the control device is not arranged on the pump device, i.e. on the pumps or on the operating means; instead, it can be spatially separated from the pump device because there will be no mechanical-structural connection between the pump device and the control device. A spatial or local separation means a separation of the components of the pump device and of the control device while there may very well be a line connection between the operating means and the control device.

Owing to the fact that the operating means and the control device can be spatially separated, a range of functions of an operating means as known from the state of the art can be distributed between the operating means and the control device and can be substantially reduced. This is particularly advantageous when an operator has to work under difficult environmental conditions, such as in a ship's hull, and has little opportunity to monitor the pump device and the operating means for correct function. This can thus take place via the control device, which can be independent from the pump device in terms of location. The operating means can thus also have a smaller range of functions compared to the state of the art, allowing less well trained operators to be employed for handling the pump device. Functions whose operation requires higher qualification will be executed by the control device. For example, the control device can be supplied with data regarding a filling level of the liquid tanks or a mixing ratio or a delivery volume of the respective pumps by the operating means. Vice-versa, extended setting of the operating means, such as presetting of a mixing ratio, can take place via the control device.

The pumps of the pump device or pump devices can be controlled independently from one another by the control device. Thus, it becomes possible to also simultaneously operate pumps of different pump devices to mix a multi-component material in case of a pump unit having more than one pump device. For instance, a first pump of a first pump device can thus be operated together with a first pump of another pump device while another pump of the first pump device and another pump of the other pump device are not being operated.

Furthermore, data can be exchanged with an external network by means of the control device. An external network means a network that cannot be attributed to the pump system. A network of this kind can be an intranet or the internet, for example. How communication takes place with the external network is immaterial. It can take place via network cables and also via a wireless radio connection. The communication with the external network offers countless options for controlling or influencing the control device. For instance, the control device make an interface for operating the control device available in the external network, which means that the control device can be operated directly via the external network through computers connected to the external network. Of course, this entails the option of limiting and/or assigning rights to the respective operators by means of the control device. Furthermore, more than one pump system can be connected to the external network, allowing these pump systems to be controlled and operated via the external network. Moreover, it is possible for the pump system(s) connected to the external network to exchange data with a producer of the pump system via the respective control devices. In this way, the producer of a defective pump system has direct access to error messages and other system information in the event of a malfunction, if required. Furthermore, the producer can update the software of the control device and influence the function of the control device. Moreover, the producer can use the data obtained by transmission from the control device(s) to create statistics that are indicative of error frequencies and of user behavior, from which an optimization of the pump system can be derived.

The operating means can transmit environmental parameters, operating states, operating parameters and/or error messages of the pump device to the control device, the control device being able to process the environmental parameters, operating states, operating parameters and/or error messages. For instance, a filling level of a liquid tank of the pump device can be continuously registered by the operating means, and the filling level can then be transmitted to the control device. The control device can execute a number of further method steps when the filling level drops below a specified filling level. Thus, the control device can issue a filling-level warning and automatically order a subsequent delivery of component material. Operating states or operating parameters, too, can be interpreted by the control device to the effect that a maintenance interval has been reached and maintenance must be performed. Error messages can be used by the control device to automatically order spare parts.

Advantageously, the control device can initiate and carry out a purging of pumps, mixers and/or spray guns of the pump device or pump devices in parallel. In this way, it is possible to automatically purge line sections or delivery lines, pumps, mixers and spray guns not being needed parallel to a dispensing of multi-component material and to clear them for immediate subsequent use. Thus, the dispensing of the multi-component material does not have to be interrupted by the purging process, whereby a significant gain of time for handling the pump system can be achieved.

In this respect, purging can take place automatically within a period of non-use of pumps, mixers and/or spray guns of the pump devices.

In an embodiment of the method, data exchange or communication with a robot can take place by means of the control device. This is advantageous if the pump system is used together with a robot for coating surfaces or if the spray gun is handled by the robot. The robot can communicate with the control device via the means of communication available to it in such a manner that a function of the pump system is controlled by the robot and is adapted to a function of the robot.

It is particularly advantageous if the data can be exchanged wirelessly between the control device and the operating means. In this way, a line connection between the operating means and the control device can be entirely omitted. A wireless connection can be easily formed through a radio connection within a common frequency band, for example. In this way, it also becomes possible to ensure data exchange with the operating means when the latter has been placed in a location with difficult access. For example, a plurality of pump devices can thus also be easily monitored by means of the control device. The control device can thus be positioned on company premises within an office building, for example, and different pump devices located on the company premises can be monitored and controlled by means of the control device via data exchange. Thus, it is also possible to monitor and statistically evaluate a use of the respective pump devices, their capacity utilization, a current location and their operating behavior.

Control commands of the control device can be superimposed in particular on control commands of the operating means. In this way, it can be ensured that potential operating mistakes of an operator during operation of the operating means can be corrected by the control device. For example, an update of software of the operating means can thus also be executed automatically by the control device. It is also conceivable to limit a possible mixing ratio of component materials to a specific range via the control device so that an operator can make adjustments within said range only.

The control device can also continuously store environmental parameters, operating states, operating parameters and/or error messages for an operating period. In this way, it becomes possible to document the aforementioned data and to store or correct a recipe after a final check of a work result. Also, potentially flawed work results or an inconsistent quality of the work results can be traced with the aid of the stored data, allowing conclusions to be drawn as to parameters that may need to be considered.

Moreover, the operating means and/or the control device can transmit environmental parameters, operating states, operating parameters and/or error messages of the pump device to the spray gun. By transmitting the aforementioned data, it is also possible for the spray gun to be automatically adjusted via motor-driven valves or via motor nozzle adjustment, for example. Moreover, the aforementioned data can also be displayed at the spray gun, allowing an operator to become immediately aware of an error message or of a filling level of a liquid tank, for example. This is particularly advantageous if the operator with the spray gun works with the spray gun at a large distance from the pump device.

The control device can transmit control commands and/or operational settings for the pump device to the operating means. Consequently, the control device can transmit settings, such as mixing ratios, pressures etc., directly to the operating means of the pump device so that an operator no longer needs to make these adjustments at the operating means. In case of a robot handling the spray gun, a control command for activating the pump device, for example, can also be passed on to the operating means.

The control device can continuously adjust the control commands and/or operational settings according to changed environmental parameters, operating states and/or operating parameters. The control commands transmitted from the control device to the operating means can be adjusted as a function of the data transmitted from the operating means to the control device. This adjustment can take place as soon as in the course of a simple control by means of a control element. This control can be performed based solely on a single environmental parameter, for example, and a comparatively complex control can be performed with a plurality of simultaneously registered data.

In a simple embodiment of the method, the operating means can be configured by means of the control device. This means that the operating means can be preset by means of the control device in such a manner that an operator does not have to make any further adjustments to the operating means.

In particular status reports such as a pressure or a temperature of the control device can be transmitted to the operating means and/or to the spray gun and can be displayed there. In this way, it is possible to provide a controller with information potentially relevant to the operator for performing the task directly at the spray gun or at the pump device.

By means of a database of the control device, a current documentation such as a circuit diagram or manuals of the pump system can be made available. In this way, it is no longer necessary to provide a printed manual or circuit diagrams. Instead, the documentation can thus be easily updated and accessed or displayed by the control device at different work locations.

By means of the control device, a status report can be sent to an external network as a function of the environmental parameters, operating states, operating parameters and/or error messages. A status report of this kind can be an error message, for example, which is sent to a producer of the pump system. The producer is thus notified in good time about a potential failure of the pump system or of components of the pump system and can localize or recognize an error based on the transmitted status reports without being on site.

In an embodiment of the method, the control device can comprise a control means and a database, wherein recipes for mixing multi-component materials can thus be stored in the database, wherein the pump unit can be controlled by means of the control means as a function of a recipe.

The control device of the pump system consequently controls the pump unit and the pump device by indicating a mixing ratio, for example. Owing to the fact that the control device has the control means together with the database, the control means can directly control the pump device in such a manner that the control means indicates a mixing ratio to the pump device according to a recipe stored in the database. This indication can take place by means of a data connection between the control means and the pump device, for example, wherein a delivery rate of the respective pumps can be adjusted according to the recipe. By storing the recipe in the database, operation of the pump system is simplified to the effect that the recipe is always available directly at the pump system and does not have to be obtained or searched for first. Furthermore, the recipe associated with each component material used can be easily selected without the need for further adjustment of the pump device or of delivery rates of the pumps. Instead, it is envisaged that the pump unit or the pump of the pump unit is automatically controlled by means of the control means without an operator having to take a closer look at the indications given in the recipes. Operation of the pump system is substantially simplified in this way, which will allow less qualified operators to be put in charge of operation of the pump system.

Furthermore, the control means can process environmental parameters, operating states, operating parameters and/or error messages, the control means being able to make adjustments or changes to the recipes in the database. Consequently, the recipes stored in the database can be changed by the control means. The recipes established under testing conditions by producers of component material can thus be adapted to real environmental conditions during operation of the pump system. If required, it is thus also possible to use mixing ratios for component materials that would not be admissible according to a recipe but in actuality render an excellent work result under certain conditions. The parameters deviating from the recipes can be tested by an operator by way of trial, for example, and in case of success or failure, they can be stored accordingly in the database via the control means by adjusting or changing the existing recipes.

The database can be synchronized with at least one other external database at regular intervals or upon request by the control device. It may be envisaged in particular that the recipes stored in the database are synchronized with recipes of the external database. In this way, it is possible to transmit recipes changed by a producer of component material into the database upon request or automatically. For this purpose, the database can be connected to the other external database at a producer of the pump system or at a producer of the component material. In this way, it is also possible that the necessity of ordering component material is signaled at the control device or that an order with the producer is triggered automatically. Optionally, the database can also be connected to a plurality of other external databases of different producers. Vice-versa, the recipes stored in the database can also be changed by a user of the pump system, and the changed recipes can in turn be transmitted to the other external database. Producers of component materials can thus gain knowledge as to the real environmental conditions and usage conditions in which the component material is actually used or can be used. Thus, recipes can be easily synchronized with producer recipes of multi component material.

The control means can also recognize a type of spray gun, mixer and/or pump device, the control means being able to correct the recipes in consideration of the respective type. In this way, it is possible to optimally adapt the respective recipe to the spray gun, the mixer and/or the pump device currently used. The pump device may also comprise one ore more heaters, which can also be considered by the control means when changing or adjusting the recipe. In this way, it becomes possible to further relieve an operator of potential adjusting and monitoring tasks.

Moreover, the control means can check environmental parameters, operating states, operating parameters and/or error messages for plausibility in consideration of the recipes. For instance, the pump device or the pump unit can be quipped with a sensor for measuring an ambient temperature, the control means thus being able to determine by way of a simple nominal/actual-value comparison whether the component material can be processed and ejected at the measured ambient temperature. Since the recipes comprise a series of parameters and range indications, which may be related to each other, the control means can thus check a setting or an operation of the pump unit within the framework of the respective recipe.

Environmental parameters, operating states, operating parameters and/or error messages of the spray gun can also be transmitted from the spray gun to the control device, the control means being able to correct the recipes in consideration of the respective environmental parameters, operating states, operating parameters and/or error messages of the spray gun. Consequently, like the pump device, the spray gun can transmit the aforementioned information and data to the control device in such a manner that the recipes stored in the database or the recipe currently being used can be corrected based on the current data situation. For instance, the spray gun can have a number of sensors by means of which the aforementioned data can be obtained. The spray gun can have an infrared temperature sensor, for example, by means of which a surface temperature of a surface to be coated can be continuously measured. Other parameters, such as an ambient temperature and a temperature of the supplied component material, can be determined by the spray gun as well. The measured temperature data allow a conclusion as to whether the multi-component material can be ejected with a satisfactory work result according to the recipe used or whether contrary to the recipe, i.e. in case of environmental conditions deviating from the recipe, a satisfactory work result can still be achieved. In this case in particular, the control device or the control means can correct the recipe and also store a user-specific recipe.

In another embodiment of the method, the control device can produce written documentation of the environmental parameters, operating states, operating parameters and/or error messages for an operating period. In particular the written documentation can be used as evidence of proper workmanship in case of defect or warranty claims, if necessary.

The pump system according to the invention comprises a pump unit for dispensing multi-component material under pressure by means of a spray gun, the pump unit comprising a pump device, a mixer and a spray gun, the pump device having at least two pumps for pumping component material and associated liquid tanks for storing component material, the pump device having an operating means for controlling the pump device, wherein the pump unit comprises at least one other pump device, the pump system having a control device, the control device and the operating means together forming a control unit, the pump unit with the pump devices being controllable by means of the control unit.

With regard to the advantageous effects of the pump system according to the invention, reference is made to the description of advantages of the method according to the invention.

The control device can be arranged at a distance from the pump unit.

The pump devices can be substantially identical. While it is also conceivable to use pump devices that each have a different number of pumps, it is more advantageous for economic reasons to use identical pump devices. In the latter case, the pump system will not have to be constructed and configured individually for a customer; instead, pump devices available by default anyway, which may also be intended for mobile use, can be used to build a stationary pump system. Aside from simple exchangeability of the pump devices, the costs for building the pump system are significantly reduced when using identical pump devices.

It may be envisaged for the control device to have an extended regulating, controlling and/or functional range compared to the operating means. Accordingly, a limited regulating controlling and/or functional range can be made available to an operator at the operating means, which substantially simplifies operation of the pump unit and of the pump device. Also, the operator is thus allowed to have less detailed technical knowledge, and potential operating mistakes can be safely precluded. It may be envisaged, for example, to make only four to ten switches on the operating means for operating the pump device and the pump unit and a simple display device available to the operator. Other functionalities can thus be operated via the control devices, the control device being able to regulate and control the full range of functions of the pump unit in this case. Accordingly, the control device can also be operated by an operator who has comparatively extensive technical knowledge. The separation of the operating means and the control device is advantageous in particular if the pump unit has multiple pump devices, each being operated by a different operator.

For instance, the control device can be realized as a device for data processing having a display element and operating elements. Accordingly, the control device can be a standardized computer, such as a personal computer with the usual input and output means like a screen and a keyboard. It is also possible for the control device to have specially configured display elements, such as an LCD or LED display, and operating elements, such a series of switches and control elements.

In a simple embodiment, the pump device can have merely two pumps. In principle, the pump device can also have more than two pumps, but the major number of pump devices regularly has two pumps only. When the pump unit is composed of a plurality of pump devices, particularly common pump devices, which thus are particularly cost-effective, can be used for building the pump unit.

The pump unit can also comprise another mixer and another spray gun. In this way, a pump unit composed of multiple pump devices can also be used by more than one operator at a time. This further also allows a quick switch between spray guns, in particular if one spray gun is used with a mixer with a first color and another spray gun is used with a mixer with a second color. Likewise, an unused spray gun with a mixer can also be purged during parallel use of another spray gun, for example.

For instance, it may be envisaged that one mixer and one spray gun are associated with each pump device. Alternatively, it is also possible to associate more than two pump devices with a spray gun and a mixer, and in case of different number of pump devices, a spray gun and a mixer can be associated with them, too.

The pump unit can have merely one pump for pumping a hardener component. Accordingly, a pump device may be provided in which a single pump is used for pumping the hardener component. The other pump device thus has no pump for pumping a hardener component. Depending on the combination of pump devices and mixers, the hardener component can be admixed by the one single pump to the component materials that are pumped by the other pumps. Thus, each pump device does not have to have a pump for pumping a hardener component material, whereby the number of pumps can be reduced.

The operating means can be configured to have a display element and operating elements. The display element of the operating means can be a simple LCD and/or LED display, for example, which is relatively small compared to the display element of the control device. Four to ten switches or control elements can be provided as operating elements for operating the basic function of the pump device.

In one embodiment, it may also be envisaged for the control device to be realized as a mobile phone. If the control device is in particular a so-called smartphone, software for controlling the operating means can easily be installed on the mobile phone. It is also possible in that case to establish a simple connection between the control device and the operating means via Bluetooth, Wi-Fi, GSM, GPRS, UMTS, LTN or other standards for data transmission. In this case, the control device can also be portable and can be carried along as a mobile device. Also, there is no need for special configuration of the control device because mobile phones of this kind are available at relatively low cost. Alternatively, of course, it is possible to use a so-called tablet computer or a notebook or netbook as the control device.

In the field of spraying technology, it is further particularly advantageous if the operating means and/or the control device is/are ATEX-compliant. In this case, each of them can be realized as a pressure-tight encapsulated unit according to ATEX guidelines for explosion protection according to equipment directive 94/9/EC and operating directive 1999/92/EC. In this way, a particularly safe operation of the pump system can be ensured.

The control device can comprise a control means for controlling the pump unit and a database, wherein recipes for mixing multi-component materials can be stored in the database.

It is particularly advantageous if the control device is configured to exchange data with an external network.

Other advantageous embodiments of the device will become apparent from the feature descriptions of the dependent claims back-referenced to method claim 1.

BRIEF DESCRIPTION OF THE DRAWING FIGURES

Hereinafter, preferred embodiments of the invention will be explained in more detail with reference to the accompanying drawings.

DETAILED DESCRIPTION OF THE INVENTION

Figure 1:
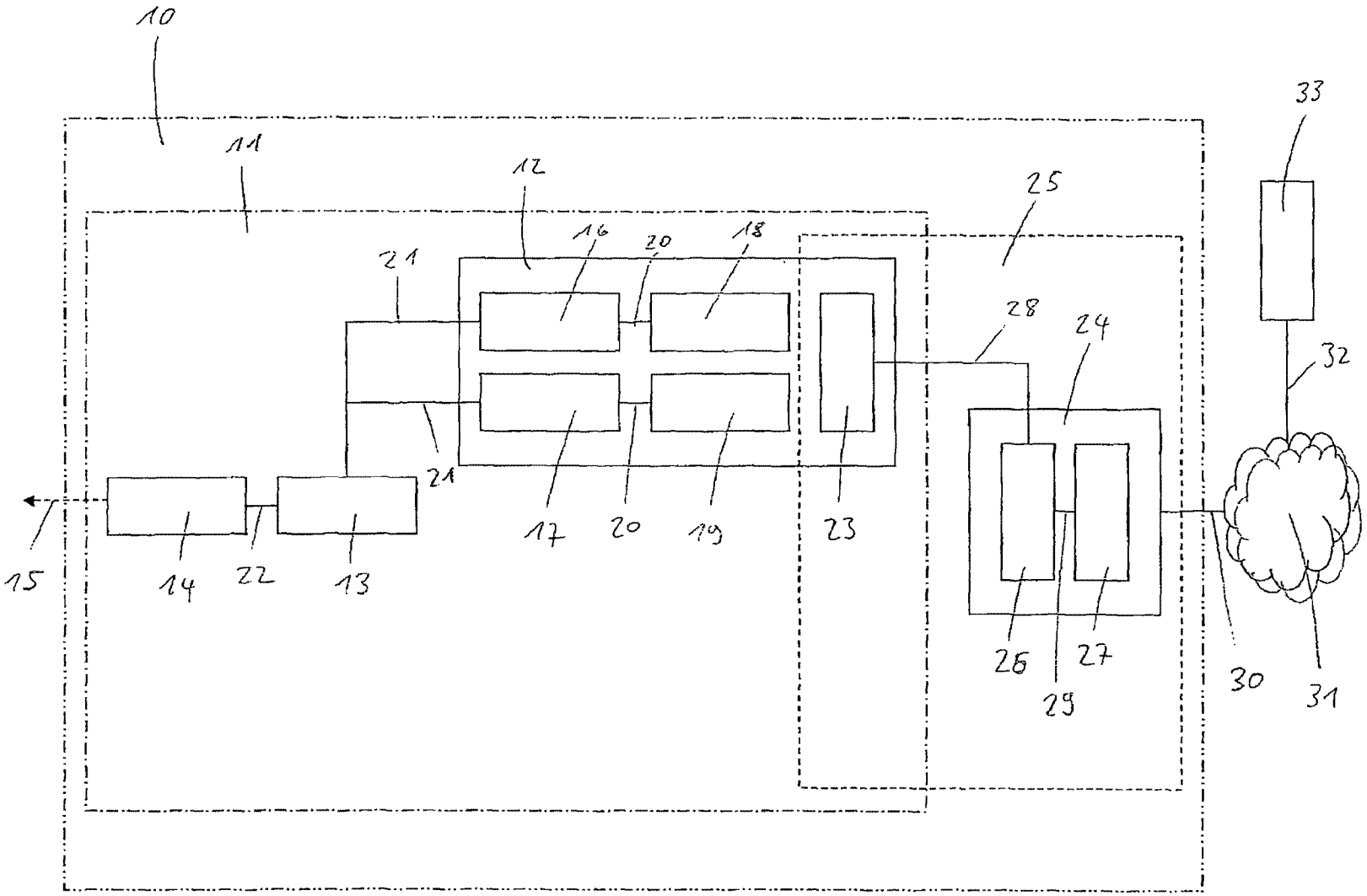
FIG. 1 shows a schematic illustration of a first embodiment of a pump system.

FIG. 1 shows a schematic illustration of a first embodiment of a pump system 10. The pump system 10 comprises a pump unit 11 composed of a pump device 12 for pumping component material, a mixer 13 and a spray gun 14. By means of the spray gun 14, a multi-component material mixed from the component materials in the mixer 13 can be sprayed or ejected onto a surface, as is indicated here by arrow 15. The pump device 12 itself comprises a first pump 16 and another pump 17 and a first liquid tank 18 and another liquid tank 19, each for receiving liquid component material. The liquid tanks 18 and 19 are connected to the pumps 16 and 17, respectively, via media lines 20, the pumps 16 and 17 being connected to the mixer 13 via media lines 21 and the mixer 13 being connected to the spray gun 14 via yet another media line 22. The pumps 16 and 17 are realized as pneumatically driven reciprocating piston pumps, allowing the pumps 16 and 17 to suction component materials from the liquid tanks 18 and 19, respectively, and to pump them under pressure via media lines 21 to the mixer 13. In the mixer 13, the component materials are thoroughly mixed, and the thus formed multi-component material is passed on to the spray gun 14 via media line 22. The spray gun 14 has a compressed-air connection (not illustrated), allowing the multi-component material to be dispensed and sprayed by means of compressed air. Moreover, the pump device 12 has an operating means 23, via which the pump devices 12 and the pump unit 11 can be easily controlled. The operating means 23 provides an operator with basic functions for operating the pump device 12.

The pump system 10 further comprises a control device 24 for controlling the operating means 23 and the pump device 12. Together with the operating means 23, the control device 25 forms a control unit 25. The control device 24 itself has a control means 26 and a database 27. The control device 24 or, more precisely, the control means 26 is connected to the operating means 23 via a schematically illustrated data connection 28 for the purpose of exchanging data. Furthermore, the control means 26 is connected to the database 27 via a data connection 29 for the purpose of exchanging data. Moreover, the control device 24 is connected to an external network 31, such as the internet, via a data connection 30. Via a data connection 32, another database 33 is connected to the external network 31. The other external network 33 is a database of the producer of the pump system 10 or of the producer of the component material, for example.

The control device 24 is preferably realized as a mobile phone (not illustrated), which means that the data connections 28 and 30 are wireless radio connections. The control device 26 thus represents a processor or data processing device of the mobile phone, and the database 27 represents a memory of the mobile phone. Compared to the operating means 23, the control device 24 has an extended range of functions. For instance, in addition to the functions usable via the operating means 23, functions of the pump device 12 and of the pump unit 11 can be used via the control device 24 that extend beyond the functions of the former. In particular by exchanging data between the operating means 23 and the control device 24, the pump device 12 can also be monitored and environmental parameters, operating states, operating parameters and/or error messages of the pump device 12 and of the pump unit 11 can be documented. This allows the control device 24 to utilize the obtained data for variable control of the pump device 12 in the manner of a closed-loop control on the one hand and the documentation of the data to be used for quality control and retrospective traceability of a work result on the other hand.

In particular database 27 contains recipes from producers of component material, by means of which the operating means 23 and the pump device 12 can be controlled. For instance, a mixing ratio of the pumps 16 and 17 can be adjusted by means of the control device 24 by varying a delivery rate of the pumps 16 and 17 via the operating means 23. An operator on site operating the spray gun 14 is thus no longer forced to directly access a recipe and to make the necessary adjustments to the pump device 12 and to the operating means 23. Moreover, potential error messages of the pump device 12 can be transmitted to the control device 24, the control device 24 also being able to pass these error messages on to the external network 31. The recipes, documentations, manuals etc. can be stored in the other database 33 and can be synchronized at regular intervals with the data stored in database 27. In this way, it is also possible to immediately send an error message by e-mail, for example, to a producer of the pump system 10 so as to initiate maintenance service, for example. Moreover, the control device 24 and, if applicable, also the operating means 23 offer the option of changing and adjusting the recipes and to store new recipes in the database 27. These changed recipes can contain additional information regarding the actual work conditions, such as temperatures, air humidity etc., allowing the control device 24 to send said data to the other database 33 so as to update or adjust the recipes lying at the producers' of component material.

Figure 2:
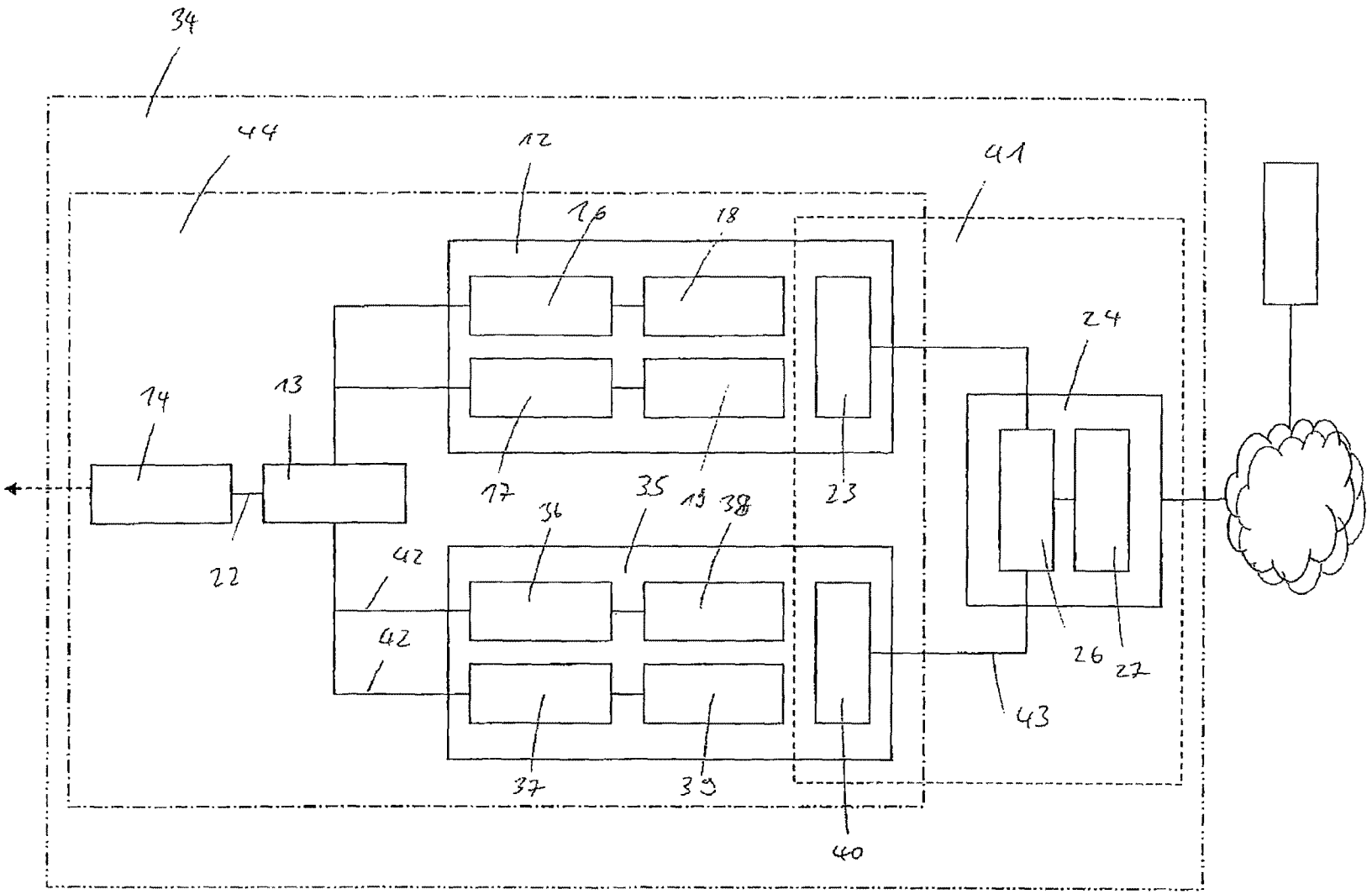
FIG. 2 shows a schematic illustration of a second embodiment of a pump system.

FIG. 2 shows a second embodiment of a pump system 34, which differs from the pump system shown in FIG. 1 in that it has another pump device 35. The other pump device 35 is equipped with a first pump 36 and another pump 37, a first liquid tank 38 and another liquid tank 39 and an operating means 40. The operating means 23 and 40 now form a control unit 41 together with the control device 24. Also, the other pump device 35 is connected to the mixer 13 and to the spray gun 14 via media lines 42 and 22. Moreover, the control means 26 is wirelessly connected to the operating means 40 via a data connection 43. By means of the control device 24, it is now possible to simultaneously control pump device 12 and pump device 35 and to combine them with the mixer 13 and the spray gun 14 to form a pump unit 44. Pump device 12 and pump device 35 are substantially identical, allowing pump device 12 or 35 to be easily exchanged in case of failure of one of them without having to shut down the pump unit 44 entirely. It is also possible to operate the pumps 16, 17 and 36, 37 completely independently from one another via the control device 24 and to connect them to one another in any combination for mixing multi-component material.

Figure 3:
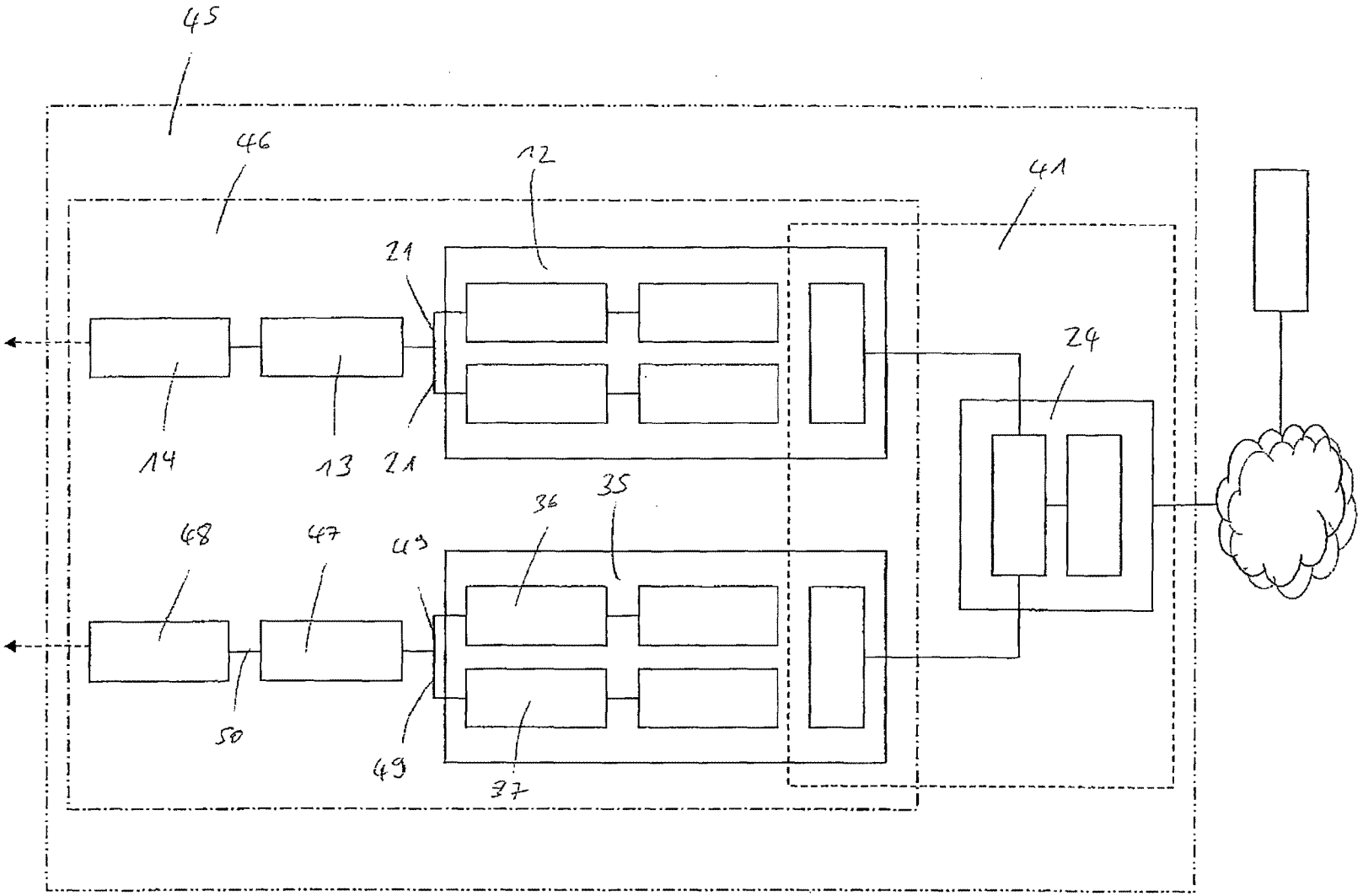
FIG. 3 shows a schematic illustration of a third embodiment of a pump system.

FIG. 3 shows a schematic illustration of a third embodiment of a pump system 45. In contrast to the pump system illustrated in FIG. 2, a pump unit 46 is quipped with another mixer 47 and another spray gun 48 in this case, the first pump 36 and the other pump 37 being connected to the miser 47 via media lines 49 and the mixer 47 being connected to the spray gun 48 via a media line 50. The pump devices 12 and 35 can thus also be used while being completely separate from each other in terms of space, and the control device 24 can also be placed separately from the pump devices 12 and 35 in terms of location and space. Still, it is possible to control and monitor the pump devices 12 and 35 simultaneously.

Figure 4:
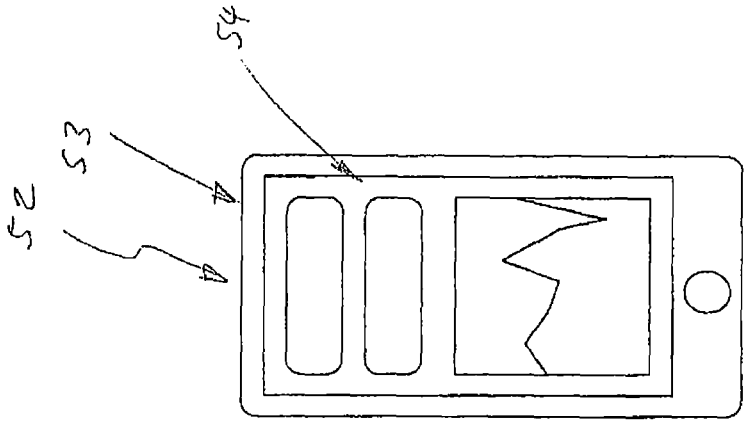
FIG. 4 shows a schematic illustration of an embodiment of a control unit.
Figure 4:
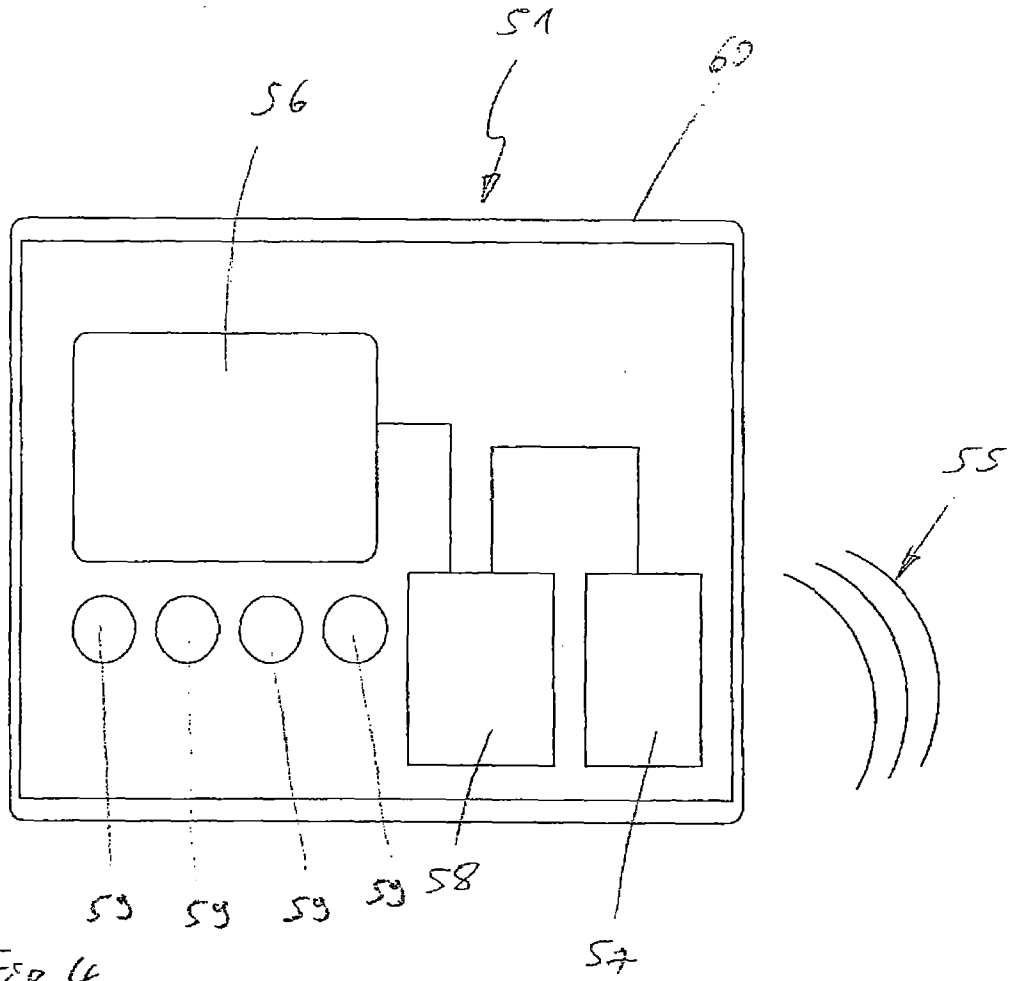

FIG. 4 shows a schematic illustration of an operating means 51 together with a control device 52. The control device 52 is realized as a mobile phone 53 having a touch screen 54 and is coupled or connected with the operating means 51 via a radio data connection 55. The operating means 51 has a screen 56, a processor 57, a PLC control 58 and operating switches 59. These components are housed in a pressure-tight encapsulated housing 60, which conforms to the ATEX standard. Owing to the operating switches 59, an operator has limited access to the functionality of the pump unit (not illustrated), full functionality of said pump unit being usable by means of the control device 52.

The invention claimed is:

1. A method for controlling a pump system (10, 34, 45) having a pump unit (11, 44, 46) for dispensing multi-component material under pressure by a spray gun, the pump unit comprising a pump device (12, 35), a mixer (13, 47) and a spray gun (14, 48), the pump device having at least two pumps (16, 17, 36, 37) for pumping component material and associated liquid tanks (18, 19, 38, 39) for storing component material, the pump device having means for operating (23, 40, 51) by which the pump device is controlled, characterized in that the pump unit has at least one other pump device (12, 35), the pump system having a control device (24, 52), the control device and the means for operating together forming a control unit (25, 41), the pump unit being controlled by the control unit; and the control device (24, 52) has an extending regulating, controlling and/or functional range compared to the controller (23, 40, 51).

2. The method according to claim 1, characterized in that the control device (24, 52) is arranged at a distance from the pump unit (11, 44, 46), data being exchanged between the control device and the operating means (23, 40, 51).

3. The method according to claim 1, characterized in that the pumps (16, 17, 36, 37) are controlled independently from one another by the control device (24, 52).

4. The method according to claim 1, characterized in that data is exchanged with an external network (31) by the control device (24, 52).

5. The method according to claim 1, characterized in that the operating means (23, 40, 51) transmits environmental parameters, operating states, operating parameters and/or error messages of the pump device (12, 35) to the control device (24, 52), the control device processing the environmental parameters, operating states, operating parameters and/or error messages.

6. The method according to claim 1, characterized in that the control device (24, 52) initiates and carries out a purging of pumps (16, 17, 36, 37), mixers (13, 47) and/or spray guns (14, 48) in parallel.

7. The method according to claim 1, characterized in that pumps (16, 17, 36, 37), mixers (13, 47) and/or spray guns (14, 48) not used during a period of time are purged automatically.

8. The method according to claim 1, characterized in that data is exchanged with a robot by means of the control device (24, 52).

9. A pump system (10, 34, 45) having a pump unit (11, 44, 46) for dispensing multi-component material under pressure by a spray gun, the pump unit comprising a pump device (12, 35), a mixer (13, 47) and a spray gun (14, 48), the pump device having at least two pumps (16, 17, 36, 37) for pumping component material and associated liquid tanks (18, 19, 38, 39) for storing component material, the pump device having a controller (23, 40, 51) for controlling the pump device, characterized in that the pump unit has at least one other pump device (12, 35), the pump system having a control device (24, 52), the control device and the controller together forming a control unit (25, 41), the pump unit being controllable by the control unit; and the control device (24, 52) has an extending regulating, controlling and/or functional range compared to the controller (23, 40, 51).

10. The pump system according to claim 9, characterized in that the control device (24, 52) is arranged at a distance from the pump unit (11, 44).

11. The pump system according to claim 9, characterized in that the pump devices (12, 35) are substantially identical.

12. The pump system according to claim 9, characterized in that the control device (24, 52) is realized as a controller (52) for data processing having a display element (54) and operating elements (54).

13. The pump system according to claim 9, characterized in that the pump device (12, 35) has merely two pumps (16, 17, 36, 37).

14. The pump system according to claim 9, characterized in that the pump unit (46) comprises another mixer (13, 47) and another spray gun (14, 48).

15. The pump system according to claim 9, characterized in that one mixer (13, 47) and one spray gun (14, 48) are associated with each pump device (12, 35).

16. The pump system according to claim 9, characterized in that the pump unit (11, 44, 46) has merely one pump (16, 17, 36, 37) for pumping a hardener component.

17. A pump system having a pump unit for dispensing multi-component material under pressure by a spray gun, the pump unit comprising a pump device, a mixer and a spray gun, the pump device having at least two pumps for pumping component material and associated liquid tanks for storing component material, the pump device having a first controller for controlling the pump device, characterized in that the pump unit has at least one other pump device, the pump system having a second controller, the first and second controllers together forming a control unit, the pump unit being controllable by the control unit; and the second controller has an extending regulating, controlling and/or functional range compared to the first controller.

* * * * *